US012281821B2

(12) United States Patent
Jeong et al.

(10) Patent No.: US 12,281,821 B2
(45) Date of Patent: Apr. 22, 2025

(54) THERMOELEMENT HEAT EXCHANGE MODULE

(71) Applicant: SUNGHA ENERGY CO., LTD., Seoul (KR)

(72) Inventors: Won Ha Jeong, Gumi-si (KR); Kyeong Hoon Cho, Gimpo-si (KR); Joung Chel Jang, Gimpo-si (KR); Sang Jin Park, Uijeongbu-si (KR); Su Jin Lee, Anyang-si (KR)

(73) Assignee: SUNGHA ENERGY CO., LTD., Seoul (KR)

( * ) Notice: Subject to any disclaimer, the term of this patent is extended or adjusted under 35 U.S.C. 154(b) by 350 days.

(21) Appl. No.: 17/648,392

(22) Filed: Jan. 19, 2022

(65) Prior Publication Data

US 2022/0136743 A1 May 5, 2022

Related U.S. Application Data

(63) Continuation-in-part of application No. PCT/KR2020/009329, filed on Jul. 15, 2020.

(30) Foreign Application Priority Data

Jul. 22, 2019 (KR) ..... 10-2019-0088398

(51) Int. Cl.
*F25B 21/02* (2006.01)
*F28F 3/10* (2006.01)

(52) U.S. Cl.
CPC ..... *F25B 21/02* (2013.01); *F28F 3/10* (2013.01); *F25B 2321/02* (2013.01); *F25B 2700/2107* (2013.01); *F28F 2230/00* (2013.01)

(58) Field of Classification Search
CPC ..... F25B 21/02; F25B 2321/02; F25B 2700/2107; F28F 3/10; F28F 2230/00; F28F 3/12; F24F 5/0042
See application file for complete search history.

(56) References Cited

U.S. PATENT DOCUMENTS

2014/0123683 A1 5/2014 Hou et al.

FOREIGN PATENT DOCUMENTS

CN 101275776 A * 10/2008 ..... F28F 21/065
DE 202018000758 U1 * 4/2018

(Continued)

OTHER PUBLICATIONS

International Search Report dated Oct. 27, 2020 in International Application No. PCT/KR2020/009329.

*Primary Examiner* — Kun Kai Ma
(74) *Attorney, Agent, or Firm* — SALIWANCHIK, LLOYD & EISENSCHENK

(57) ABSTRACT

Proposed is a thermoelement heat exchange module including a body and a thermoelement. The body has a cooling water flow path through which cooling water flows and has an opening which communicates with the cooling water flow path, and has an inlet which is formed at a first side thereof to communicate with the cooling water flow path and through which cooling water is introduced and has an outlet which is formed at a second side thereof to communicate with the cooling water flow path and through which cooling water is discharged. The thermoelement has a first surface thereof coupled to a portion where the opening of the body is formed such that the first surface is exposed on the cooling water flow path. The cooling water flow path has a portion having a relatively small hydraulic diameter in a flow direction of cooling water.

8 Claims, 11 Drawing Sheets

(56) References Cited

FOREIGN PATENT DOCUMENTS

| | | | | | |
|---|---|---|---|---|---|
| EP | 0949464 | A1 | * | 10/1999 | |
| JP | 7-260287 | A | | 10/1995 | |
| JP | 2002-250572 | A | | 9/2002 | |
| JP | 3560391 | B2 | * | 9/2004 | ..... H01L 35/30 |
| JP | 2005307232 | A | * | 11/2005 | |
| JP | 4022278 | B2 | * | 12/2007 | |
| JP | 2013092280 | A | * | 5/2013 | |
| JP | 2015128351 | A | * | 7/2015 | |
| KR | 10-1565560 | B1 | | 11/2015 | |
| KR | 10-1800374 | B1 | | 11/2017 | |
| KR | 10-2082243 | B1 | | 2/2020 | |

* cited by examiner

〈CONVENTIONAL TECHNOLOGY〉

COOLING WATER DISCHARGE TEMPERATURE 27.7℃

<PRESENT DISCLOSURE>

COOLING WATER DISCHARGE TEMPERATURE 29.1℃

THERMOELEMENT HEAT EXCHANGE MODULE

CROSS REFERENCE TO RELATED APPLICATIONS

This application is a continuation-in-part of International Patent Application No. PCT/KR2020/009329, filed Jul. 15, 2020, which claims the benefit under 35 U.S.C. § 119 of Korean Application No. 10-2019-0088398, filed Jul. 22, 2019, the disclosures of each of which are incorporated herein by reference in their entirety.

TECHNICAL FIELD

The present disclosure relates to a thermoelement heat exchange module configured such that a thermoelement is coupled to a cooling block through which cooling water flows and a first surface of the thermoelement is directly in contact with the cooling water, thereby cooling the thermoelement.

BACKGROUND ART

Generally, in hot summer weather, a person can feel cool through the blowing of a fan. However, there is a problem that a temperature of air blown through the fan cannot be maintained lower than a temperature of the atmosphere, so that there has been an inconvenience in using the fan.

Accordingly, an air conditioner capable of supplying cool air having a temperature lower than the temperature of the atmosphere by using condensation and evaporation of a refrigerant has been developed. However, there was a problem that a condenser for condensing the refrigerant made a lot of noise and a user felt displeasure. Further, there has been a problem that it is difficult to move and install the air conditioner due to a complex structure and a large volume of the air conditioner.

In addition, since a dedicated gas, not a fluid such as water that is easily available to a user, has been used as a refrigerant, there has been a problem of environmental pollution by the refrigerant as well as the inconvenience of maintenance.

To solve the problems, in Korean Utility Model Registration No. 20-0204571 "AIRCONDITIONER WITH THERMO ELECTRIC MODULE", a cooling device having a simple structure using a thermoelement has been developed. However, due to heat resistance of a structure that is disposed between cooling water for cooling a heat radiation surface of the thermoelement and the heat radiation surface of the thermoelement, there has been a problem that heat generated from the heat radiation surface of the thermoelement is difficult to be effectively transferred to the cooling water.

That is, the heat radiation surface of the thermoelement is not directly in contact with the cooling water, and the heat is transferred through a water-cooling kit that is for circulating the cooling water, so that there has been a problem that the difference in the heat resistance was large depending on the heat conductivity of the water-cooling kit, thereby causing loss of the cooling efficiency.

Therefore, since the cooling water did not efficiently cool the heat generated from the heat radiation surface of the thermoelement, there has been a problem that it was difficult to maximize the cooling efficiency.

In addition, when the cooling efficiency and the number of the thermoelement were insufficient, there has been a problem that the cooling efficiency was gradually decreased due to long-term use. Further, there has been a problem that condensed water was excessively generated on a heat absorption surface of the thermoelement in a cold state due to the temperature difference with the atmosphere even after the power is turned off.

In addition, in a thermoelement power generation device that produces electricity by using the temperature difference between a cooling surface and a heating surface of a thermoelement, it was difficult to efficiently cool the cooling surface of the thermoelement, and it was difficult to increase the efficiency of the thermoelement power generation device.

DISCLOSURE

Technical Problem

Accordingly, the present disclosure has been made keeping in mind the above problems occurring in the related art, and an objective of the present disclosure is to provide a thermoelement heat exchange module configured such that a first surface of a thermoelement is cooled by being directly in contact with cooling water, so that the thermoelement heat exchange module is capable of increasing the cooling efficiency by uniformly cooling the first surface of the thermoelement.

Technical Solution

In order to achieve the above objectives of the present disclosure, there is provided a thermoelement heat exchange module including: a body provided with a cooling water flow path through which cooling water flows and provided with an opening that is in communication with the cooling water flow path, the body being provided with an inlet which is formed on a first side thereof to be in communication with the cooling water flow path and into which the cooling water is introduced, and the body being provided with an outlet which is formed on a second side thereof to be in communication with the cooling water flow path and through which the cooling water is discharged; and a thermoelement having a first surface coupled to a portion where the opening of the body is formed such that the first surface is exposed on the cooling water flow path, wherein a portion having a relatively small hydraulic diameter in a flow direction of the cooling water exists on the cooling water flow path that connects the inlet to the outlet.

In addition, the cooling water flow path between the inlet and the outlet may have a bottleneck structure in the flow direction of the cooling water.

In addition, the bottleneck structure may be configured such that a protruding portion that protrudes from the first surface of the thermoelement or from a first surface of the body facing the first surface of the thermoelement is formed.

In addition, the protruding portion may be configured such that opposite sides of the protruding portion in a width direction perpendicular to a longitudinal direction that connects the inlet to the outlet in a straight line are spaced apart from side surfaces of the cooling water flow path in the width direction.

In addition, the protruding portion may be configured such that a surface thereof facing the thermoelement is formed in a plane shape.

In addition, the cooling water flow path between the inlet and the outlet may have a guide vane in the flow direction of the cooling water.

In addition, the guide vane may be formed on at least one of a vicinity of the inlet and a vicinity of the outlet.

In addition, the guide vane may include a plurality of guide vanes disposed in parallel.

In addition, the cooling water flow path of the body may be formed wider in a longitudinal direction and in a width direction than in a height direction, and the inlet and the outlet may be formed to be in communication with the cooling water flow path in the height direction.

In addition, a seating portion may be concavely formed along a circumference of the opening of the body, and the thermoelement may be inserted into and coupled to the seating portion.

In addition, the thermoelement heat exchange module may further include a sealing member interposed between the body and the thermoelement, and the sealing member may be configured to inhibit leakage of the cooling water.

Advantageous Effects

In the thermoelement heat exchange module of the present disclosure, there is an advantage that the cooling efficiency is increased since the first surface of the thermoelement is uniformly cooled by the flowing cooling water.

BEST MODE

Hereinafter, a thermoelement heat exchange module of the present disclosure will be described in detail with reference to accompanying drawings.

Figure 1:
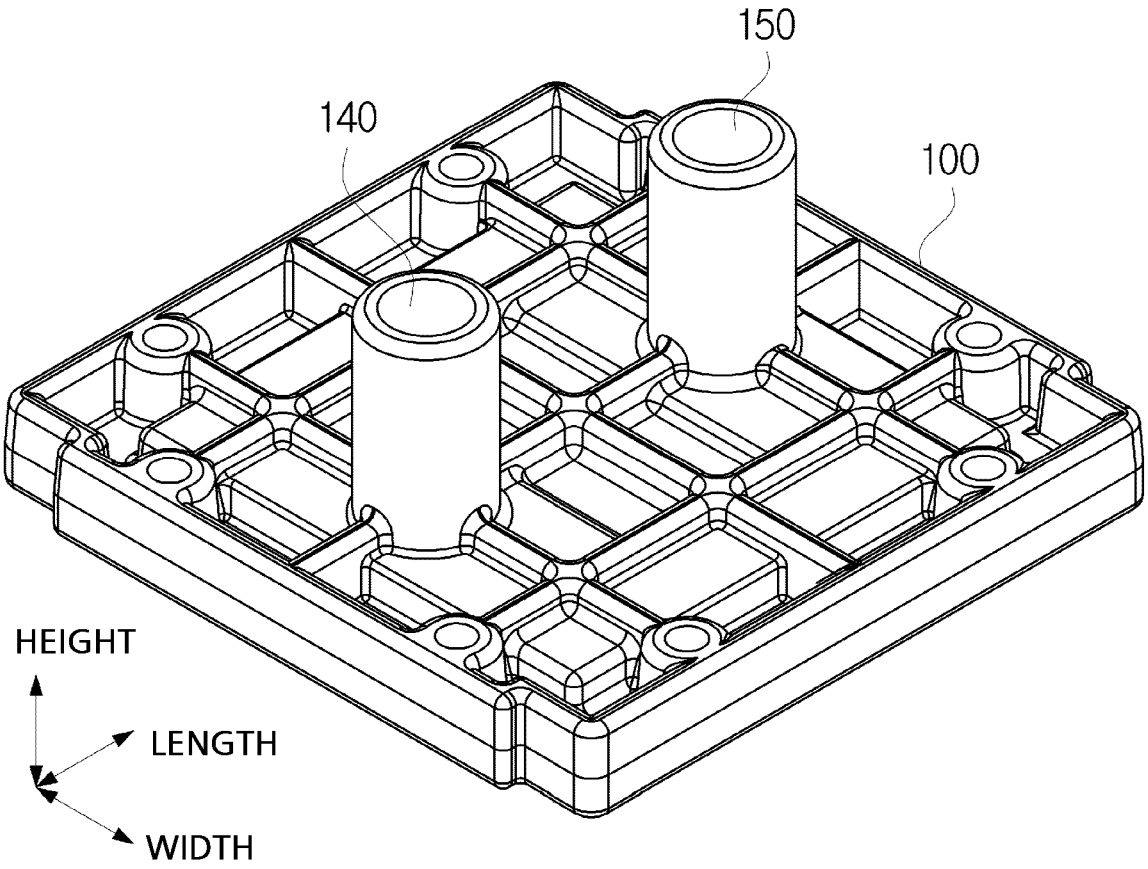
FIGS. 1 and 2 are an assembled perspective view and an exploded perspective view illustrating a thermoelement heat exchange module according to an embodiment of the present disclosure.
Figure 2:
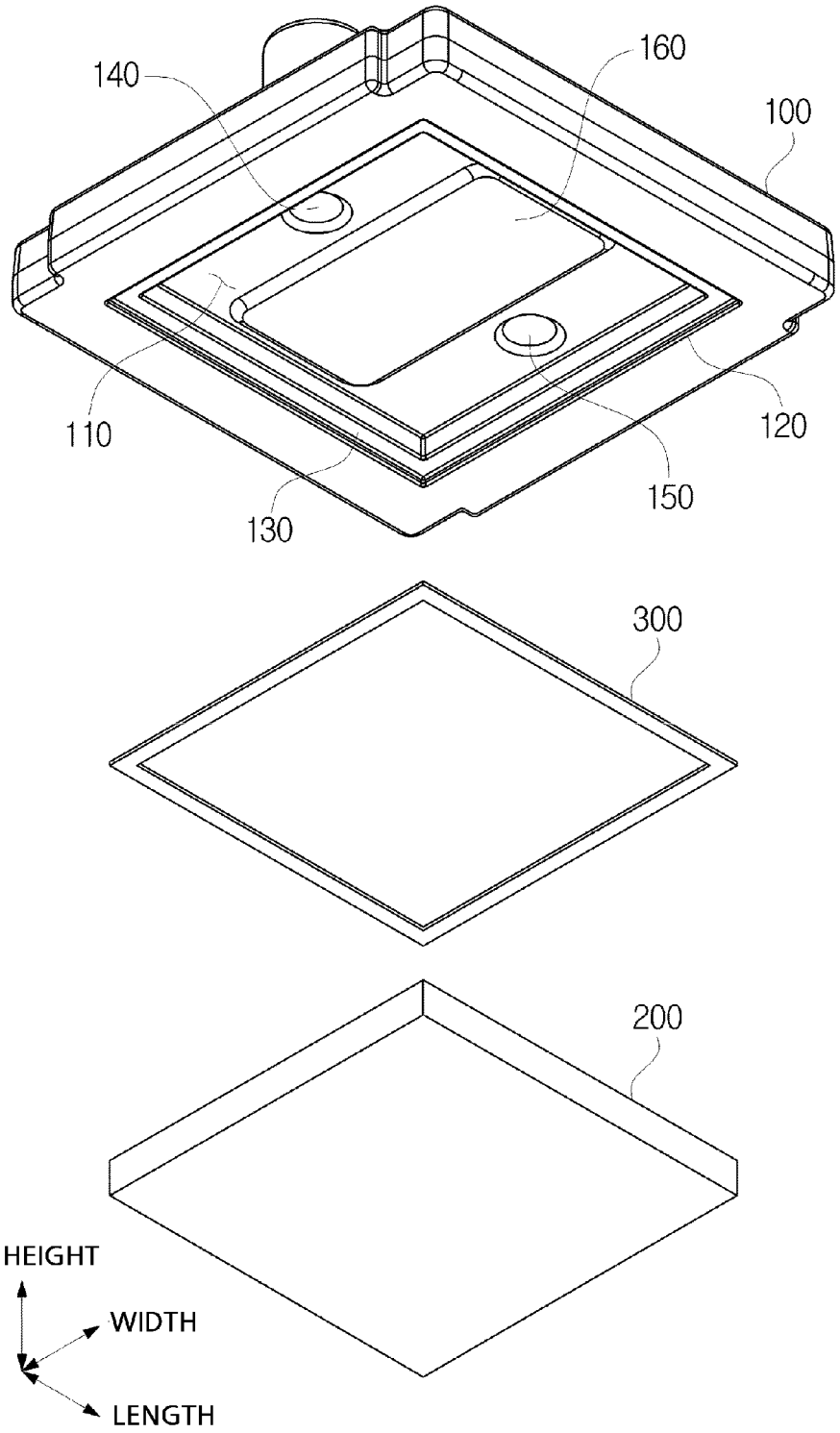
Figure 3:
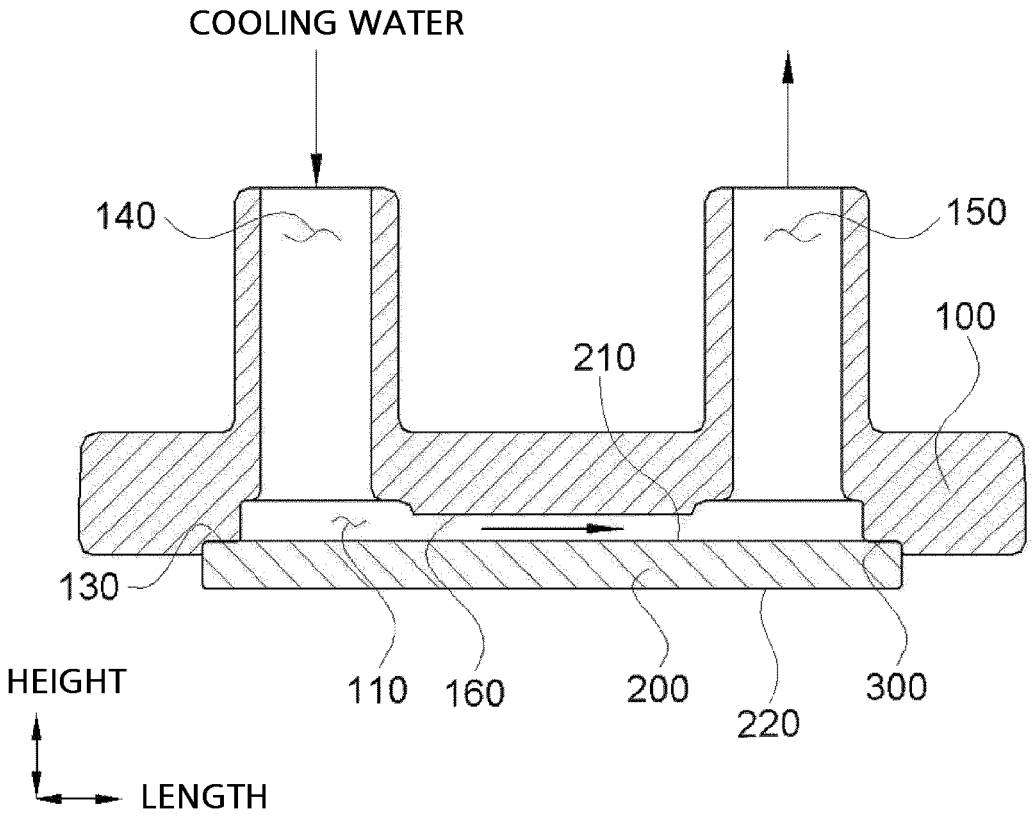
FIGS. 3 and 4 are a front cross-sectional view and a side cross-sectional view illustrating the thermoelement heat exchange module according to an embodiment of the present disclosure.
Figure 4:
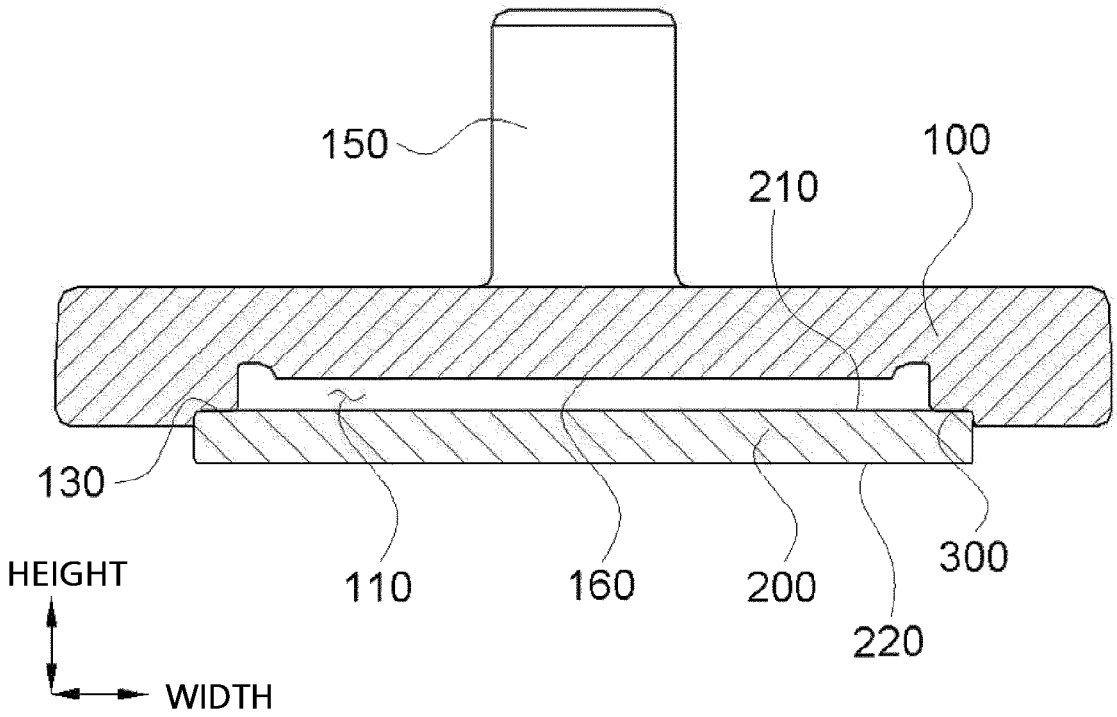
Figure 5:
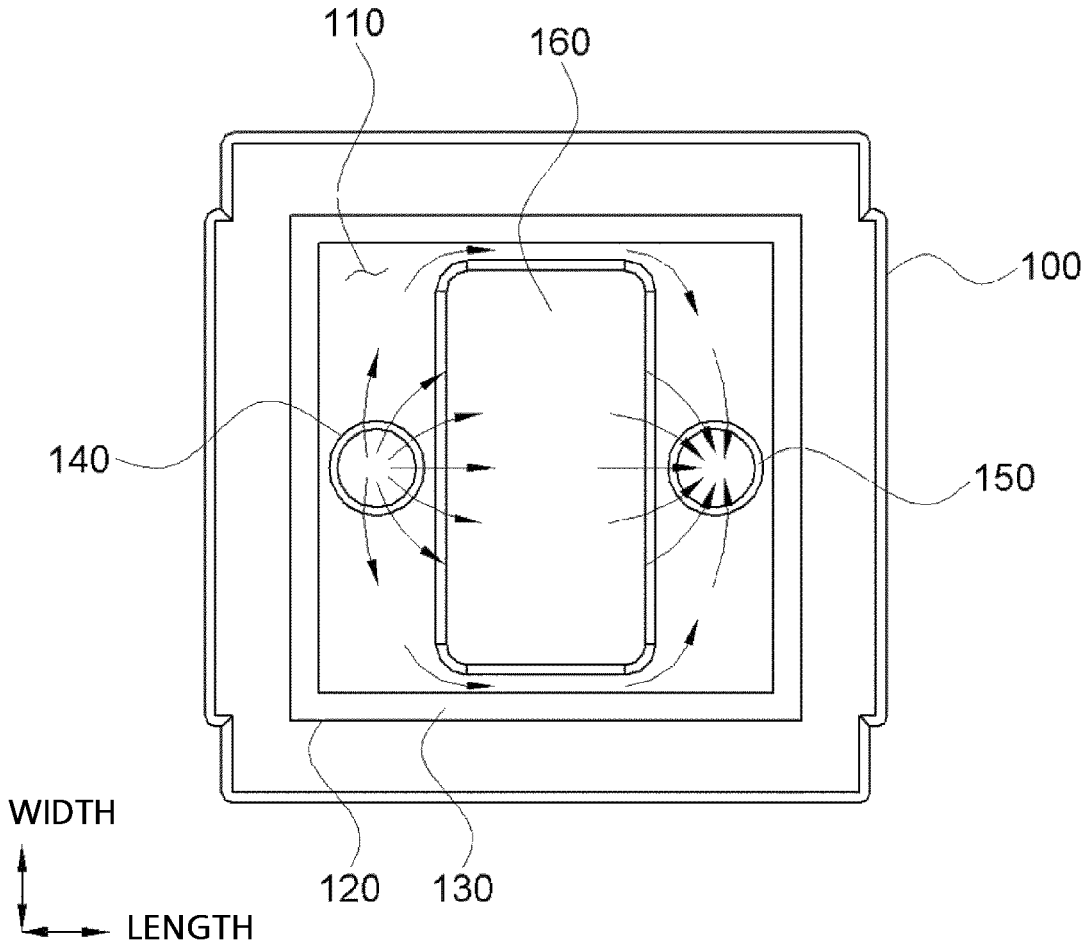
FIG. 5 is a plan view illustrating a cooling water flow path of a body in which a protruding portion is formed in the thermoelement heat exchange module according to an embodiment of the present disclosure when viewed from the bottom.

FIGS. 1 to 4 are an assembled perspective view, an exploded perspective view, a front cross-sectional view, and a side cross-sectional view illustrating a thermoelement heat exchange module according to an embodiment of the present disclosure, and FIG. 5 is a plan view illustrating a cooling water flow path of a body in which a protruding portion is formed in the thermoelement heat exchange module according to an embodiment of the present disclosure when viewed from the bottom.

As illustrated in the drawings, the thermoelement heat exchange module according to an embodiment of the present disclosure may include a body 100 and a thermoelement 200, and may further include a sealing member 300 interposed between the body 100 and the thermoelement 200.

An outer appearance of the body 100 may be formed in a substantially rectangular parallelepiped shape, and may be formed in a plate shape in which lengths in a longitudinal direction and a width direction of the plate are relatively longer than a thickness of the plate in a height direction. In addition, a cooling water flow path 110 through which cooling water flows may be formed inside the body 100, and an opening 120 that is in communication with the cooling water flow path 110 may be formed on a bottom surface of the body 100. In addition, a seating portion 130 formed in an upwardly concaved stepped shape may be formed along a circumference of the opening 120. An inlet 140 into which the cooling water is introduced may be formed on a first side of the body 100 in the longitudinal direction, and an outlet 150 through which the cooling water is discharged may be formed on a second side of the body 100 in the longitudinal direction. For example, the cooling water flow path 110 is formed in a rectangular shape when viewed from the bottom. Further, the inlet 140 may be formed on a center portion of one side that forms the rectangle, and the outlet 150 may be formed on a center portion of the other side that forms the rectangle.

A heat radiation surface 210, which is a first surface, may be formed on an upper portion of the thermoelement 200, and a heat absorption surface 220, which is a second surface, may be formed on a lower portion of the thermoelement 200. Further, the thermoelement 200 may be a Peltier element that absorbs heat from the heat absorption surface 220 and radiates the heat to the heat radiation surface 210 when electric current is supplied thereto. For example, the heat radiation surface 210 of the thermoelement 200 is coupled to the body 100, and the upper portion of the thermoelement 200 on which the heat radiation surface 210 is formed is coupled to the body 100 by being inserted into the seating portion 130 of the body 100 as illustrated in the drawings. Further, the heat radiation surface 210 is exposed on the cooling water flow path 110, and may be configured such that the cooling water passing through the cooling water flow path 110 is directly in contact with the heat radiation surface 210. In addition, the lower portion of the thermoelement 200 on which the heat absorption surface 220 is formed may be formed in a structure that protrudes downward and that is exposed to the outside. Therefore, the cooling water introduced into the cooling water flow path 110 by passing through the inlet 140 that is in communication with the cooling water flow path 110 may be discharged through the outlet 150 after cooling the heat radiation surface 210 by being directly in contact with the heat radiation surface 210 of the thermoelement 200 while passing through the cooling water flow path 110. As the cooling water directly receives the heat that is generated from the heat radiation surface 210 of the thermoelement 200, there is no loss of cooling caused by heat resistance of a heat transfer medium interposed in the middle, so that the heat radiation surface 210 of the thermoelement 200 may be rapidly cooled. Alternatively, the heat absorption surface 220 of the thermoelement 200 may be coupled to the body 100 and the heat absorption surface 220 may be exposed on the cooling water flow path 110, so that the cooling water may serve to cool the heat absorption surface 220 or may serve to maintain the heat absorption surface 220 at a predetermined temperature or less. At this time, the heat radiation surface 210 of the thermoelement 200 may be exposed to the outside of the body 100. Alternatively, when the thermoelement 200 is used as a cooling device of a power generation device such as a power generation module, a cooling surface (heat radiation portion) of the thermoelement 200 may be coupled to the body 100 such that the cooling surface is exposed on the cooling water flow path 110 of the body 100, and a heating surface (heat absorption portion) of the thermoelement 200 may be exposed to the outside of the body 100. Therefore, by the Seeback effect of the thermoelement 200, electricity may be produced by absorbing heat from the outside of the body through the heating surface and discharging the heat to the cooling water through the cooling surface.

Here, in the thermoelement heat exchange module of the present disclosure, a portion having a relatively small hydraulic diameter in a flow direction of the cooling water exists in the cooling water flow path 110 that connects the inlet 140 to the outlet 150. For example, as illustrated in the drawings, a protruding portion 160 having a rectangular plate shape may protrude downward from a first surface of the body 100 facing the heat radiation surface 210 of the thermoelement 200, and the protruding portion 160 may protrude at a height spaced apart from the heat radiation surface 210 of the thermoelement 200. In addition, the protruding portion 160 may be formed such that a surface facing the heat radiation surface 210 of the thermoelement 200 is formed in a plane shape and the heat radiation surface 210 of the thermoelement 200 may be formed in a plane shape. In addition, although not illustrated in the drawings, another protruding portion may protrude upward from the heat radiation surface 210 of the thermoelement 200, and may be spaced apart from the first surface of the body 100. At this time, another protruding portion may be formed such that a surface thereof facing the cooling water flow path 110 is formed in a plane shape and a surface of the cooling water flow path 110 facing another protruding portion may be formed in a plane shape.

In addition, opposite sides of the protruding portion 160 in the width direction that is perpendicular to the longitudinal direction connecting the inlet 140 and the outlet 150 in a straight line are formed such that the opposite sides of the protruding portion 160 are spaced apart from opposite sides of the cooling water flow path 110 in the width direction, so that a bottleneck structure in which a flow cross-sectional area through which the cooling water flows becomes relatively narrow may be formed on the vicinity of opposite side end portions of the protruding portion 160 in the width direction. In addition, the bottleneck structure may be formed such that a flow cross-sectional area in the entire portion where the protruding portion 160 is formed is narrower than a flow cross-sectional area around a portion where the inlet 140 is formed and a flow cross-sectional area around a portion where the outlet 150 is formed. By the bottleneck structure as described above, the portion having the relatively small hydraulic diameter may be formed on the cooling water flow path 110 in the flow direction of the cooling water. At this time, in a region in the longitudinal direction where the protruding portion 160 is formed, a flow cross-sectional area of a portion where the protruding portion 160 does not exist in the width direction is larger than a flow cross-sectional area of a portion where the protruding portion 160 exists in the width direction. That is, the less resistance to flow and the shorter the flow path, the more cooling water flows. Therefore, in the present disclosure, since the bottleneck structure is formed by using the protruding portion 160, the flow of the cooling water is guided outward in the width direction rather than a center portion in the width direction connecting the inlet 140 to the outlet 150. Accordingly, the flow of the cooling water does not be concentrated in a specific portion, and spreads widely and uniformly, so that the heat radiation surface 210 of the thermoelement 200 may be effectively cooled. In addition, as the protruding portion 160 is formed, a dead zone where the cooling water does not flow on the vicinity of the heat radiation surface 210 of the thermoelement 200 or where the flow of the cooling water is stagnated in a portion of the cooling water flow path 110 is reduced, so that the cooling efficiency may be increased. In addition, since the flow rate of the cooling water at the region where the protruding portion 160 is formed is increased, the heat radiation surface 210 of the thermoelement 200 may be effectively cooled.

Figure 6:
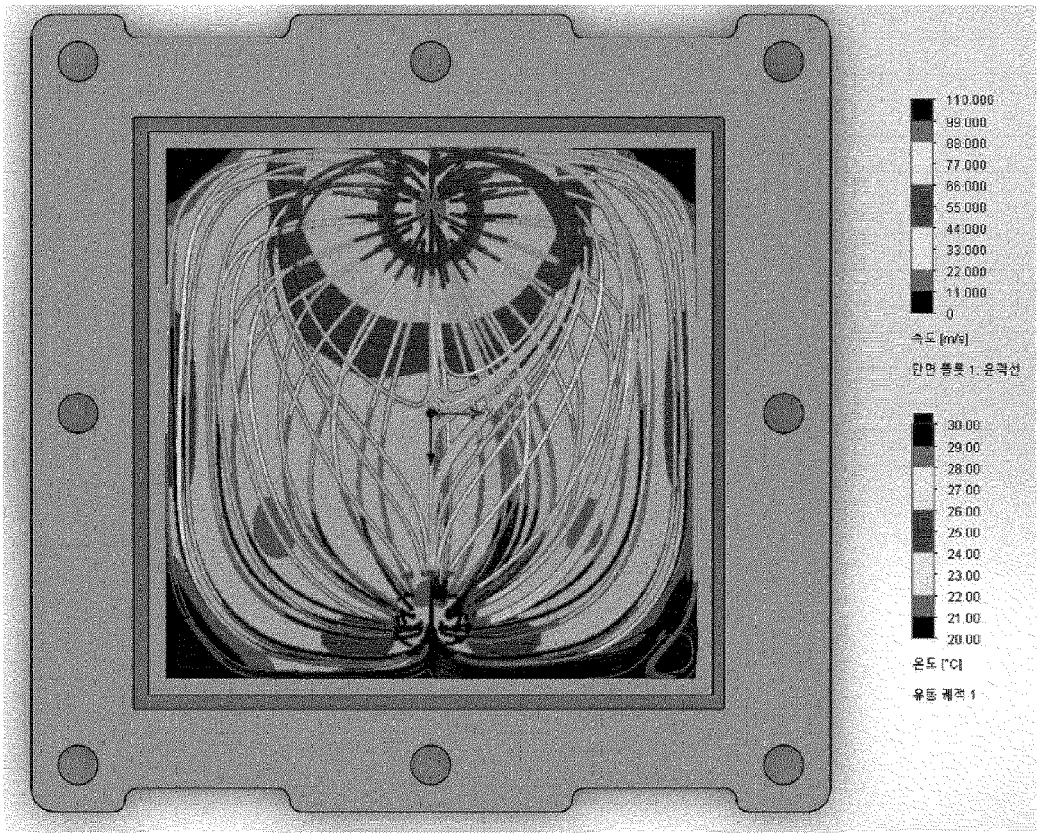
FIG. 6 shows a test result analyzing a temperature of cooling water in a conventional thermoelement heat exchange module in which the protruding portion is not provided on the cooling water flow path.
Figure 6:
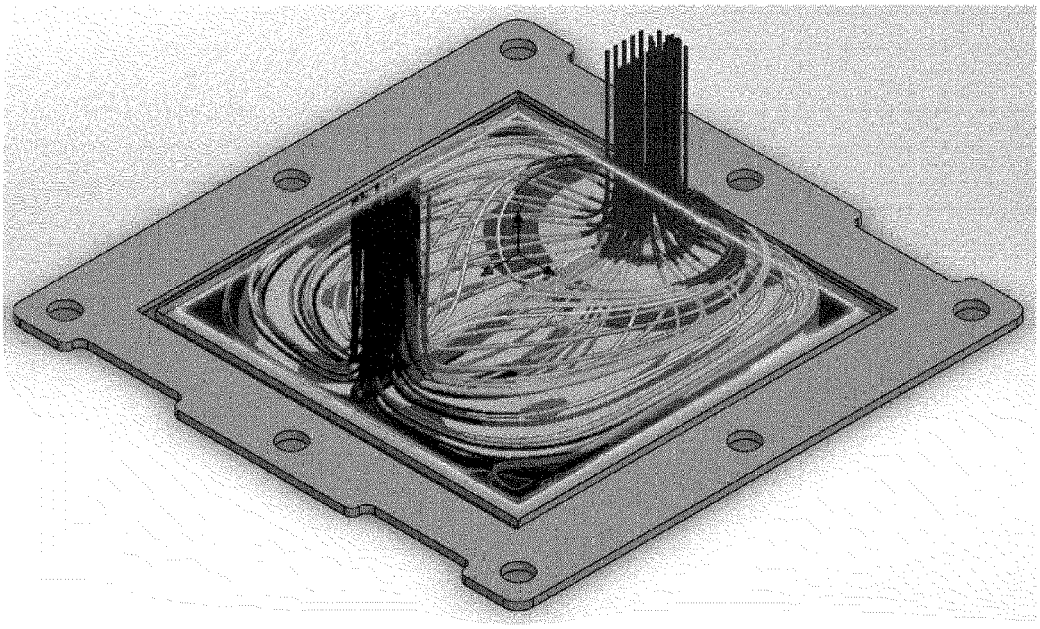
Figure 7:
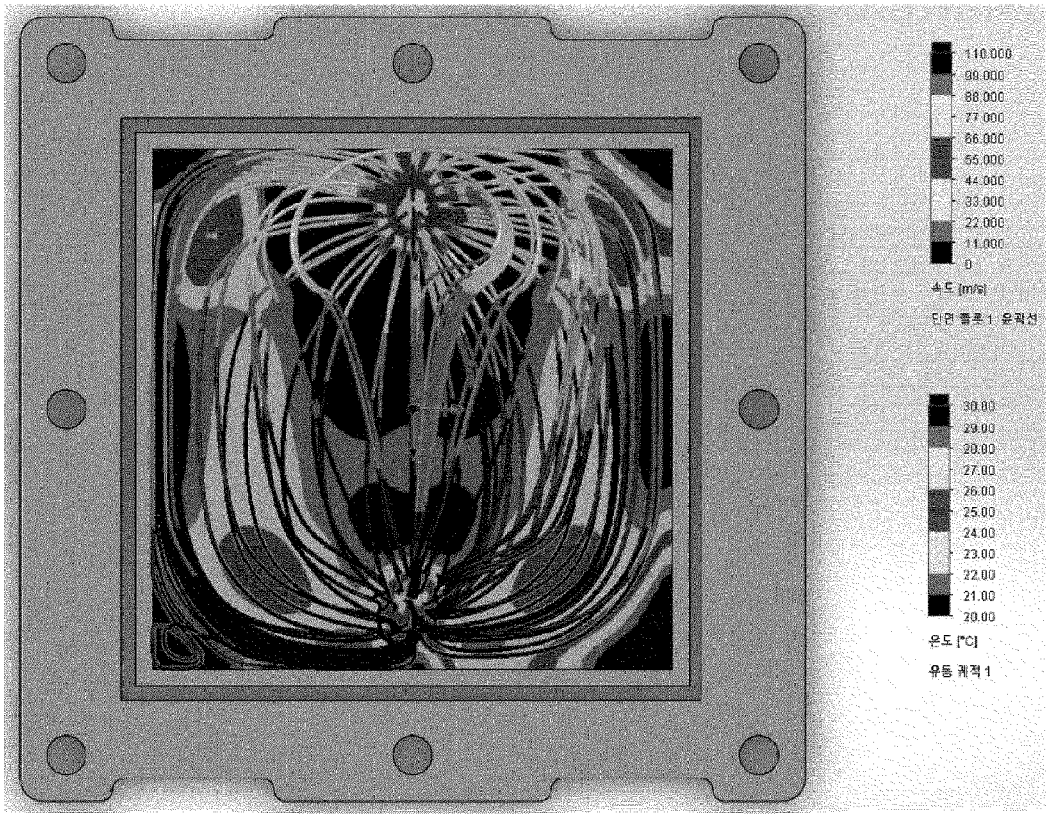
FIG. 7 shows a test result analyzing a temperature of cooling water in the thermoelement heat exchange module according to an embodiment of the present disclosure.
Figure 7:
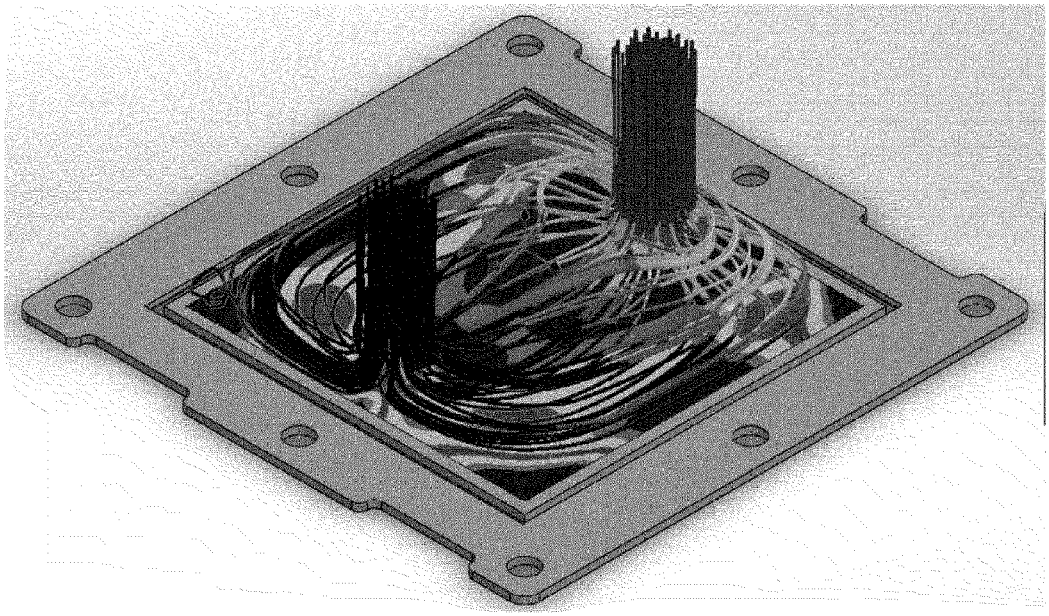

FIG. 6 shows a test result analyzing a temperature of cooling water in a conventional thermoelement heat exchange module in which the protruding portion is not provided in the cooling water flow path, and FIG. 7 shows a test result analyzing a temperature of cooling water in the thermoelement heat exchange module according to an embodiment of the present disclosure.

As a result of testing under the condition that only the presence or absence of the protruding portion was different as illustrated in the drawings, in the conventional thermoelement heat exchange module in which the protruding portion 160 is not provided, the discharge temperature at the outlet port 150 through which the cooling water is discharged was 27.7 degrees Celsius. In the thermoelement heat exchange module of the present disclosure, the discharge temperature at the outlet port 150 was 29.1 degrees Celsius. That is, the discharge temperature of the cooling water in the present disclosure was higher than the discharge temperature of the cooling water in the conventional thermoelement heat exchange module, which means that the heat exchange performance in the thermoelement heat exchange module of the present disclosure is improved compared to the heat exchange performance in the conventional thermoelement heat exchange module.

Figure 8:
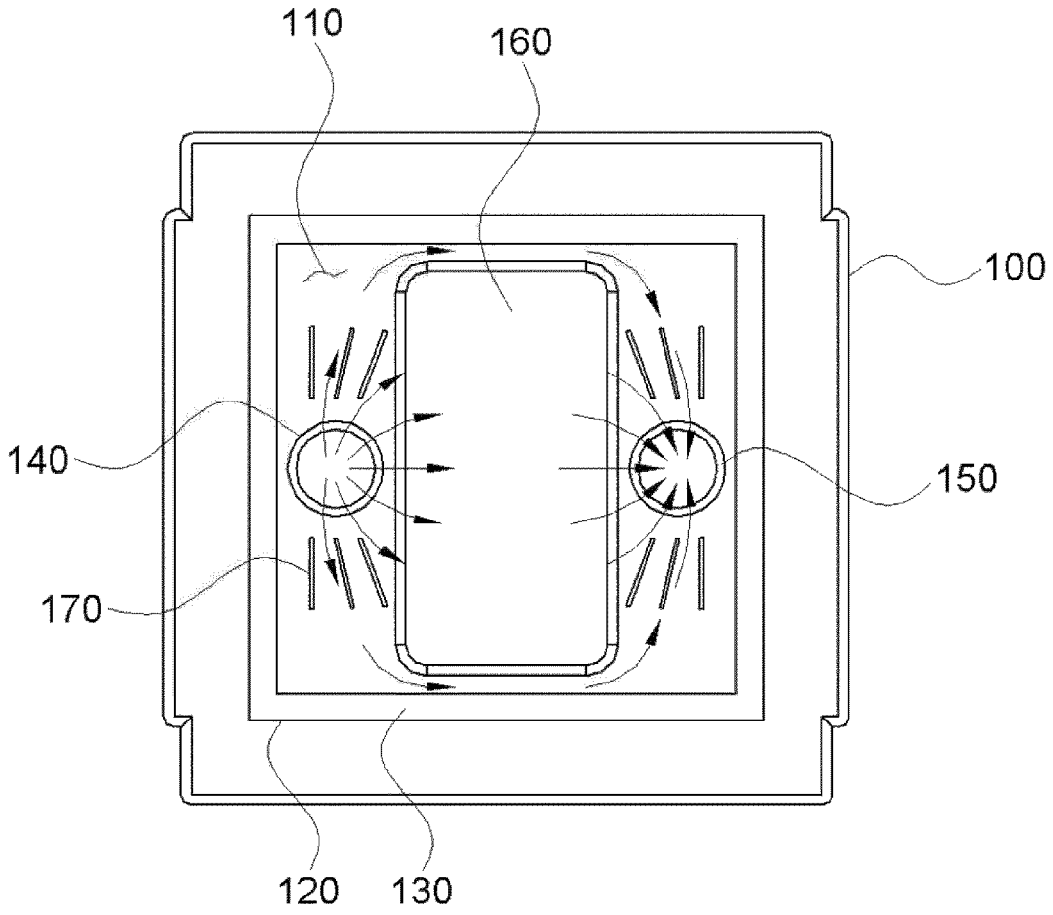
FIG. 8 is a plan view illustrating the cooling water flow path of the body in which guide vanes are formed in the thermoelement heat exchange module according to an embodiment of the present disclosure when viewed from the bottom.

FIG. 8 is a plan view illustrating the cooling water flow path of the body in which guide vanes are formed in the thermoelement heat exchange module according to an embodiment of the present disclosure when viewed from the bottom.

As illustrated in the drawings, in the body 100, guide vanes 170 guiding the flow of the cooling water may be formed on a surface where the cooling water flow path 110 is formed, and the guide vanes 170 may be formed on at least one of a vicinity of the inlet 140 and a vicinity of the outlet 150 that are in communication with the surface where the cooling water flow path 110 is formed. At this time, a portion where the guide vanes 170 are formed may be a portion having a relatively small hydraulic diameter in the flow direction of the cooling water, and the guide vanes 170 may be an additional configuration of the protruding portion 160. In addition, the guide vanes 170 may be formed in a plate shape parallel to the height direction, and may be formed in various shapes such as a flat plate, a curved plate, or the like.

Figure 9:
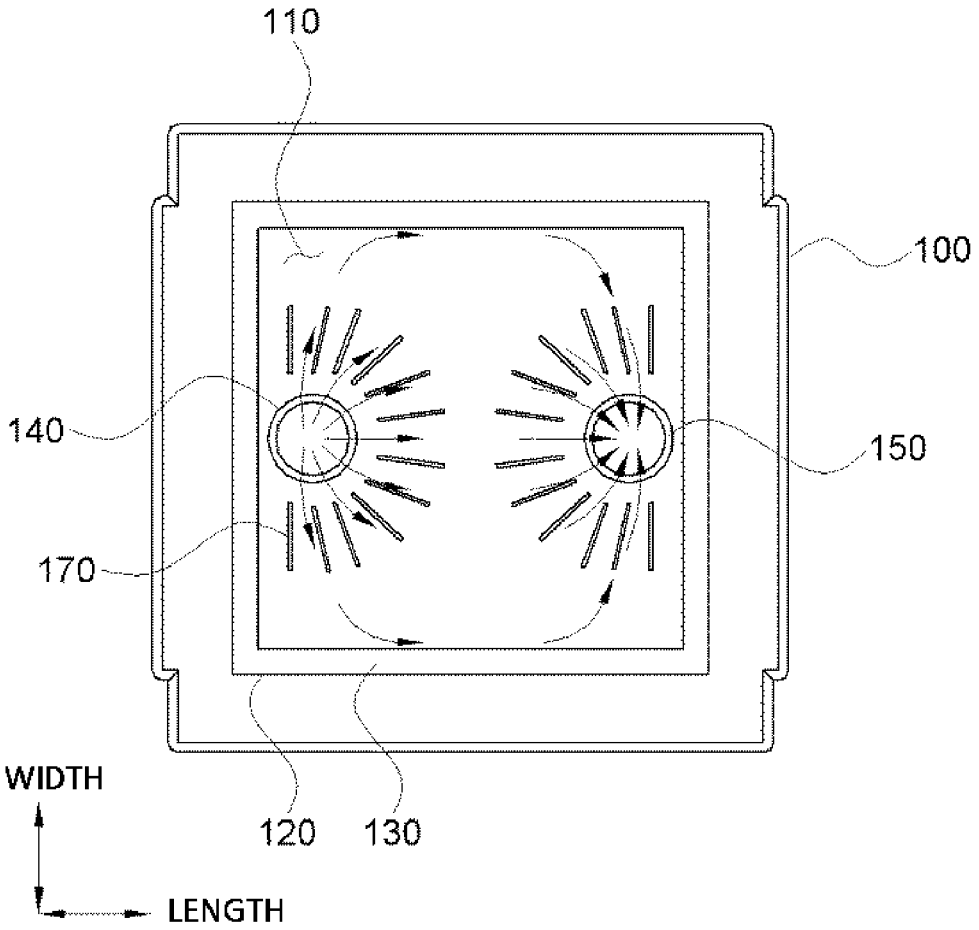
FIG. 9 is a bottom plan view illustrating the thermoelement heat exchange module according to an embodiment of the present disclosure in which only the guide vanes are formed and the protruding portion is not formed.

In addition, as illustrated in FIG. 9, only the guide vanes 170 may be formed and the protruding portion 160 may not be formed, and the cooling water may uniformly spread and flow through the entire cooling water flow path 110.

In addition, a plurality of guide vanes 170 may be disposed in parallel. Further, as described in the drawings, the guide vanes 170 may be spaced apart from the inlet 140 along a circumference of the inlet 140 and may be disposed in a radial shape around the inlet 140, or may be disposed in other shapes and positions. Similarly, the guide vanes 170 may be variously disposed around the outlet 150. This allows the cooling water flowing from the inlet 140 to the cooling water flow path 110 to be uniformly spread through the cooling water flow path 110, and the cooling water passing through the cooling water flow path 110 may spread over a wide region and may be introduced into the outlet 150.

Figure 10:
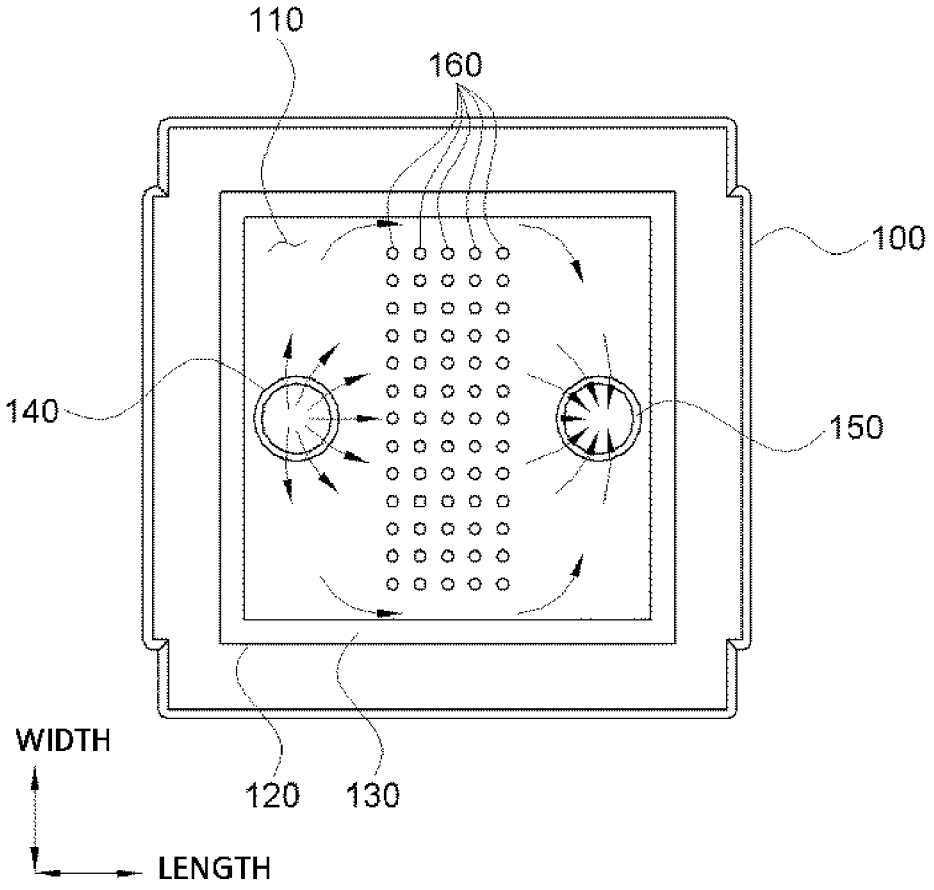
FIGS. 10 and 11 are a bottom plan view and a front cross-sectional view illustrating another embodiment of the protruding portion in the thermoelement heat exchange module according to an embodiment of the present disclosure.
Figure 11:
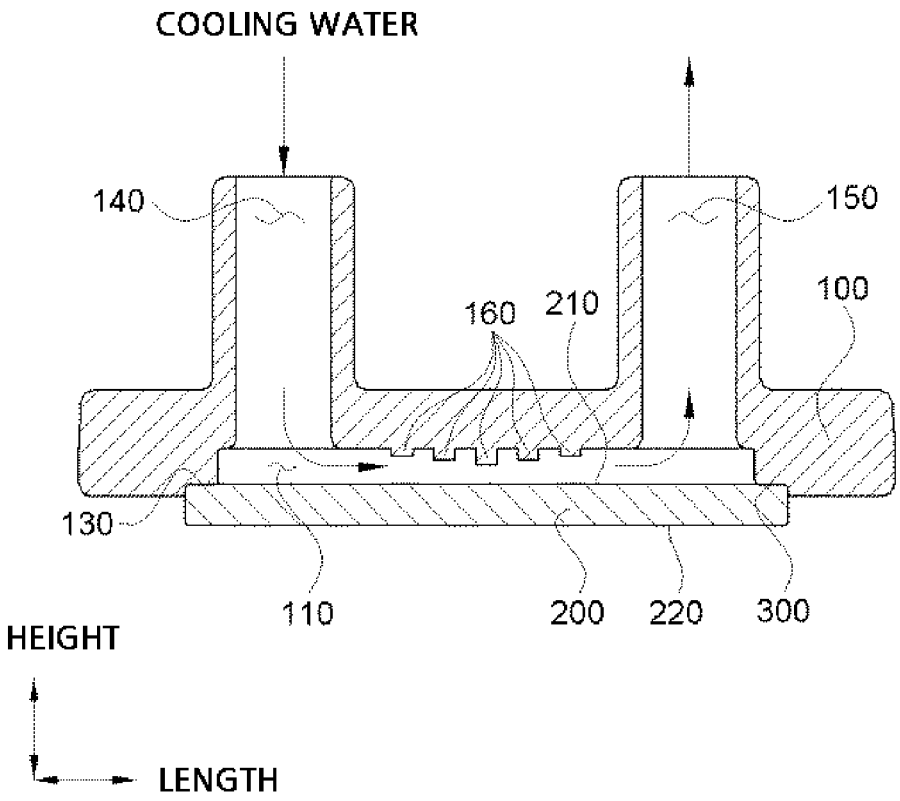

In addition, as illustrated in FIGS. 10 and 11, the bottleneck structure may be formed such that the protruding portion 160 is formed in a structure in which a plurality of protrusions is spaced apart on a surface facing the heat radiation surface 210 of the thermoelement 200 among surfaces forming the cooling water flow path 110. At this time, on a region where the plurality of protrusions is formed, the plurality of protrusions may be formed in a structure in which a distance between end portions of the plurality of protrusions and the heat radiation surface 210 of the thermoelement 200 becomes narrower from the outside of the region in the longitudinal direction toward a center of the region. In addition, the protrusions may be formed in various shapes.

In addition, the cooling water flow path 110 is formed wider in the longitudinal and width directions than in the height direction, and the inlet 140 and the outlet 150 may be formed to be in communication with the cooling water flow path 110 in the height direction. That is, as illustrated in the drawings, the inlet 140 and the outlet 150 are formed in the height direction, and a lower end of the inlet 140 and a lower end of the outlet 150 may be formed on a top surface of the cooling water flow path 110 among the surfaces forming the cooling water flow path 110. Accordingly, the cooling water flowing out of the inlet 140 and flowing into the cooling water flow path 110 flows in a shape that is spreading outward in the radial direction of the inlet 140, and the cooling water passing through the cooling water flow path 110 flows in a shape that is gathering toward a center portion in the radial direction of the outlet 150, so that the cooling water may pass through the cooling water flow path 110 in a shape that is more uniformly spreading over a large area and gathering through the large area. Therefore, the heat radiation surface 210 of the thermoelement 200 may be rapidly and effectively cooled.

In addition, the sealing member 300 interposed between the body 100 and the thermoelement 200 and configured to inhibit leakage of the cooling water may further be included. As described above, on the bottom surface of the body 100, the thermoelement 200 is inserted into and coupled to the seating portion 130 when in a state in which the sealing member 300 is inserted into the seating portion 130 concavely formed along the circumference of the opening 120 that is in communication with the cooling water flow path 110, so that a space between the seating portion 130 and the thermoelement 200 may be sealed since the sealing member 300 is closely attached therebetween. In addition, the sealing member 300 may be formed of various materials such as an elastic material and so on, and the sealing member 300 may be formed by applying the sealing member 300 on the seating portion 130. In addition, the sealing member 300 may be formed of a member in which adhesive portions are formed on both upper and lower portions thereof, so that the sealing member 300 may serve to couple the body 100 to the thermoelement 200 by bonding and also may serve to inhibit the leakage of the cooling water.

The present disclosure is not limited to the embodiments described above, and may be variously applied. In addition, the present disclosure may be variously modified by those skilled in the art to which the present disclosure pertains without departing from the spirit of the present disclosure claimed in the claims.

| [Description of Reference Numerals] | |
|---|---|
| 100: Body | |
| 110 Cooling water flow path | 120: Opening |
| 130: Seating portion | 140: Inlet |
| 150: Outlet | 160: Protruding portion |
| 170: Guide vanes | |
| 200: Thermoelement | |
| 210: Heat radiation surface | 220: Heat absorption surface |
| 300: Sealing member | |

The invention claimed is:

1. A thermoelement heat exchange module comprising:

a body provided with a cooling water flow path through which cooling water flows and provided with an opening that is in communication with the cooling water flow path, the body being provided with an inlet which is formed on a first side thereof to be in communication with the cooling water flow path and into which the cooling water is introduced, and the body being provided with an outlet which is formed on a second side thereof to be in communication with the cooling water flow path and through which the cooling water is discharged; and a thermoelement having a first surface coupled to a portion where the opening of the body is formed such that the first surface is exposed on the cooling water flow path, wherein a portion having a relatively small hydraulic diameter in a flow direction of the cooling water exists on the cooling water flow path that connects the inlet to the outlet, wherein the cooling water flow path between the inlet and the outlet has a bottleneck structure in the flow direction of the cooling water, wherein the bottleneck structure is configured such that a protruding portion that protrudes from the first surface of the thermoelement or from a first surface of the body facing the first surface of the thermoelement is formed, and wherein the protruding portion is configured such that opposite sides of the protruding portion in a width direction perpendicular to a longitudinal direction that connects the inlet to the outlet in a straight line are spaced apart from side surfaces of the cooling water flow path in the width direction.

2. The thermoelement heat exchange module of claim 1, wherein the protruding portion is configured such that a surface thereof facing the thermoelement or a surface thereof facing the cooling water flow path is formed in a plane shape.

3. The thermoelement heat exchange module of claim 1, wherein the cooling water flow path between the inlet and the outlet has a guide vane in the flow direction of the cooling water.

4. The thermoelement heat exchange module of claim 3, wherein the guide vane is formed on at least one of a vicinity of the inlet and a vicinity of the outlet.

5. The thermoelement heat exchange module of claim 3, wherein the guide vane comprises a plurality of guide vanes disposed in parallel.

6. The thermoelement heat exchange module of claim 1, wherein the cooling water flow path of the body is formed wider in a longitudinal direction and in a width direction than in a height direction, and the inlet and the outlet are formed to be in communication with the cooling water flow path in the height direction.

7. The thermoelement heat exchange module of claim 1, wherein a seating portion is concavely formed along a circumference of the opening of the body, and the thermoelement is inserted into and coupled to the seating portion.

8. The thermoelement heat exchange module of claim 1, further comprising a sealing member interposed between the body and the thermoelement, the sealing member being configured to inhibit leakage of the cooling water.

* * * * *